US007597258B2

(12) United States Patent
Feldkamp et al.

(10) Patent No.: US 7,597,258 B2
(45) Date of Patent: Oct. 6, 2009

(54) CONFIDENTIAL ELECTRONIC ELECTION SYSTEM

(75) Inventors: Gerald B. Feldkamp, Beaverton, OR (US); G. Scott Scholler, Poway, CA (US); Michael J. Baum, Portland, OR (US); Robert C. Thompson, Warren, OR (US)

(73) Assignee: CCComplete, Inc., Portland, OR (US)

( * ) Notice: Subject to any disclaimer, the term of this patent is extended or adjusted under 35 U.S.C. 154(b) by 315 days.

(21) Appl. No.: 11/739,039

(22) Filed: Apr. 23, 2007

(65) Prior Publication Data

US 2007/0246534 A1 Oct. 25, 2007

Related U.S. Application Data

(60) Provisional application No. 60/745,372, filed on Apr. 21, 2006, provisional application No. 60/806,984, filed on Jul. 11, 2006.

(51) Int. Cl.
*G07C 13/00* (2006.01)

(52) U.S. Cl. ..... 235/386; 705/12; 235/51

(58) Field of Classification Search ..... 235/386, 235/51, 50 A, 54 F; 705/12
See application file for complete search history.

(56) References Cited

U.S. PATENT DOCUMENTS

| | | | | |
|---|---|---|---|---|
| 5,218,528 | A | 6/1993 | Wise et al. | |
| 5,412,727 | A | 5/1995 | Drexler et al. | |
| 5,612,871 | A | 3/1997 | Skogmo | |
| 5,821,508 | A | 10/1998 | Willard | |
| 6,081,793 | A | 6/2000 | Challener et al. | |
| 6,250,548 | B1 | 6/2001 | McClure et al. | |
| 6,550,675 | B2 | 4/2003 | Davis et al. | |
| 6,726,090 | B1 | 4/2004 | Kargel | |
| 6,769,613 | B2 | 8/2004 | McDermott et al. | |
| 6,873,966 | B2 | 3/2005 | Babbitt et al. | |
| 6,950,948 | B2 | 9/2005 | Neff | |
| 2001/0037234 | A1 | 11/2001 | Parmasad et al. | |
| 2002/0077885 | A1 | 6/2002 | Karro et al. | |
| 2002/0083126 | A1 * | 6/2002 | Best et al. | 709/203 |
| 2002/0133396 | A1 | 9/2002 | Barnhart | |
| 2002/0138341 | A1 | 9/2002 | Rodriguez et al. | |
| 2002/0158118 | A1 | 10/2002 | Winnett | |

(Continued)

OTHER PUBLICATIONS

Schneier, Bruce, "Applied Cryptography," 1994, John Wiley & Sons, Inc., pp. 107-108.

*Primary Examiner*—Michael G Lee
*Assistant Examiner*—Keith Goodman, Jr.
(74) *Attorney, Agent, or Firm*—Kolisch Hartwell, PC

(57) ABSTRACT

A system is provided for improved elections which may separate the identity of the voter from the content of the vote she casts. The system may be implemented using electronic or other communication methods. Separate entities may be used to implement the system, with one entity acting as a member services system, and another entity acting as an election services system. The member services system may control voter information for all members of a group eligible to vote in a specific election. The election services system may control the voting process, including receiving votes from members, without having access to the voter information controlled by the member services system. The two entities might be configured so that no single person or organization may connect the voter information to a particular vote. This separation of voter information from information in the members' votes may comply with various government regulations relating to elections.

50 Claims, 14 Drawing Sheets

U.S. PATENT DOCUMENTS

| | | | | |
|---|---|---|---|---|
| 2003/0154124 | A1 | 8/2003 | Neff | |
| 2003/0159032 | A1 | 8/2003 | Gerck | |
| 2003/0178484 | A1 | 9/2003 | Vadura et al. | |
| 2003/0208395 | A1 | 11/2003 | McClure et al. | |
| 2003/0212593 | A1 | 11/2003 | Weiss | |
| 2004/0046021 | A1* | 3/2004 | Chung | 235/386 |
| 2004/0117244 | A1 | 6/2004 | Scott | |
| 2005/0211778 | A1 | 9/2005 | Biddulph | |
| 2005/0216332 | A1 | 9/2005 | Lewin | |
| 2007/0051804 | A1* | 3/2007 | Anderson et al. | 235/386 |
| 2007/0187498 | A1* | 8/2007 | Haas | 235/386 |

* cited by examiner

FIGURE 10A

| M-TAG | MID | NAME | VAC | ADDRESS |
|---|---|---|---|---|
| ABCDE | Mwhite | WHITE, MARY | Oias4d4 | 123 Mill St. |

FIGURE 10B

| M-TAG | L-TAG | ATTRIBUTES | B-TAG |
|---|---|---|---|
| ABCDE | abcde | DUES_PAID: Y<br>ACTIVE: Y<br>ORG: LOCAL 59<br>CLASS: MECHANIC | 98563245 |

FIGURE 10C

| B-TAG | VCN | BALLOT RECEIPT |
|---|---|---|
| 98563245 | 5646-8435 | 1. Candidate A<br>2. Candidate C |

CONFIDENTIAL ELECTRONIC ELECTION SYSTEM

CROSS REFERENCE TO RELATED APPLICATIONS

This application claims the benefit of and priority under 35 U.S.C. § 119(e) to U.S. Provisional Patent Application No. 60/745,372 entitled "CONFIDENTIAL ELECTRONIC ELECTION METHOD AND APPARATUS," filed Apr. 21, 2006; and 60/806,984 entitled "CONFIDENTIAL ELECTRONIC ELECTION METHOD AND APPARATUS," filed Jul. 11, 2006, the disclosures of which are incorporated herein by reference.

BACKGROUND

An election system is disclosed that may include different systems for performing different functions of an election held by an organization having members. For example, one system may perform member registration, and another system may perform the actual election services. In some examples, one or more systems may be precluded from having certain respective member information.

An election system may be used to provide voting by an established group, such as a member-based organization. Further, an election system may use data processing systems and communication with the voters. For example, data processing may be provided by computerized systems, and communication between system components and personnel may be performed electronically, such as through the use of wireless or land-based (wired) telephone systems and/or computer systems, including local or wide-area networks, such as the Internet and world-wide web.

Elections for member-based organizations (for example, labor unions) may be conducted through a mixture of on-site, mail-in paper, and electronic (including, but not limited to, telephone and Internet) voting processes. Electronic voting methods may have reduced cost and complexity compared to the other two methods, and may provide audit trails that may be used to detect abuses of the voting system.

To support such auditing, existing electronic voting systems allow both a voter's identity and the content of that voter's vote to be accessible by computer operators that have direct access to tables in a database containing the voters' identities and the content of their votes. However, labor unions are required to conduct elections in conformity with the Labor-Management Reporting and Disclosure Act of 1959. Compliance with the Labor-Management Reporting and Disclosure Act is determined by the U.S. Department of Labor, which regulates elections. The Department of Labor may determine that a method of voting may be unacceptable if it allows any single individual to link a voter's identity and her vote.

References disclosing voting-related apparatus, systems and methods include U.S. Pat. Nos. 5,218,528, 5,412,727, 5,821,508, 6,081,793, 6,550,675, 6,769,613, 6,950,948 and 6,873,966, and U.S. Patent Application Publication Nos. 2001/0037234, 2002/0077885, 2002/0133396, 2002/0138341, 2002/0158118, 2003/0154124, 2003/0159032, 2003/0208395, 2003/0212593, 2004/0046021, 2005/0216332, 2005/0211778 and 2004/0117244, which references are incorporated by reference herein in their entirety for all purposes.

BRIEF SUMMARY

An election system is disclosed that may be configured to establish and preserve a separation of the identities of the voters from the contents of their votes. In some examples, two or more non-affiliated parties must collude in order to compromise this separation, as acquisition of both the identity of the voter and the content of the voter's vote is otherwise prevented. Additionally, such a system may separate the determination of voter eligibility from the voter's identity, providing further confidentiality.

For example, an election system may include one or more computer systems. In one example, a computer system may be configured to store member-identifying information of members in a group of members associated with an election, and a unique member code in association with each member. The member code may not include member-identifying information. The computer system may be configured to store an indication of which member has voted, but not store the content of the vote of the member.

Another example of a computer system may be configured to receive from each voting member the member code of the member and authenticate each voting member by verifying that the member code received from the voting member is a valid member code based on a list of member codes. The computer system may be further configured to receive a vote from each voting member and store the vote received from each voting member in association with the verified member code. In some examples, the computer system may be configured to transmit to a separate computer system storing member-identifying information, a list of member codes associated with members that have voted without information related to how the member voted. The computer system additionally may be configured to not store, at any time during the election, member-identifying information in association with each member code or in association with each member vote.

BRIEF DESCRIPTION OF THE DRAWINGS

FIGS. 10A-C show example data tables that may be stored at various election-system entities.

DETAILED DESCRIPTION OF VARIOUS EMBODIMENTS

An election system may prevent the linking by a single entity of the identity of a voter and the contents of her vote. Such a system may be in compliance with any expected interpretation of the Labor-Management Reporting and Disclosure Act by the Department of Labor.

I. Components of Election System

Figure 1:
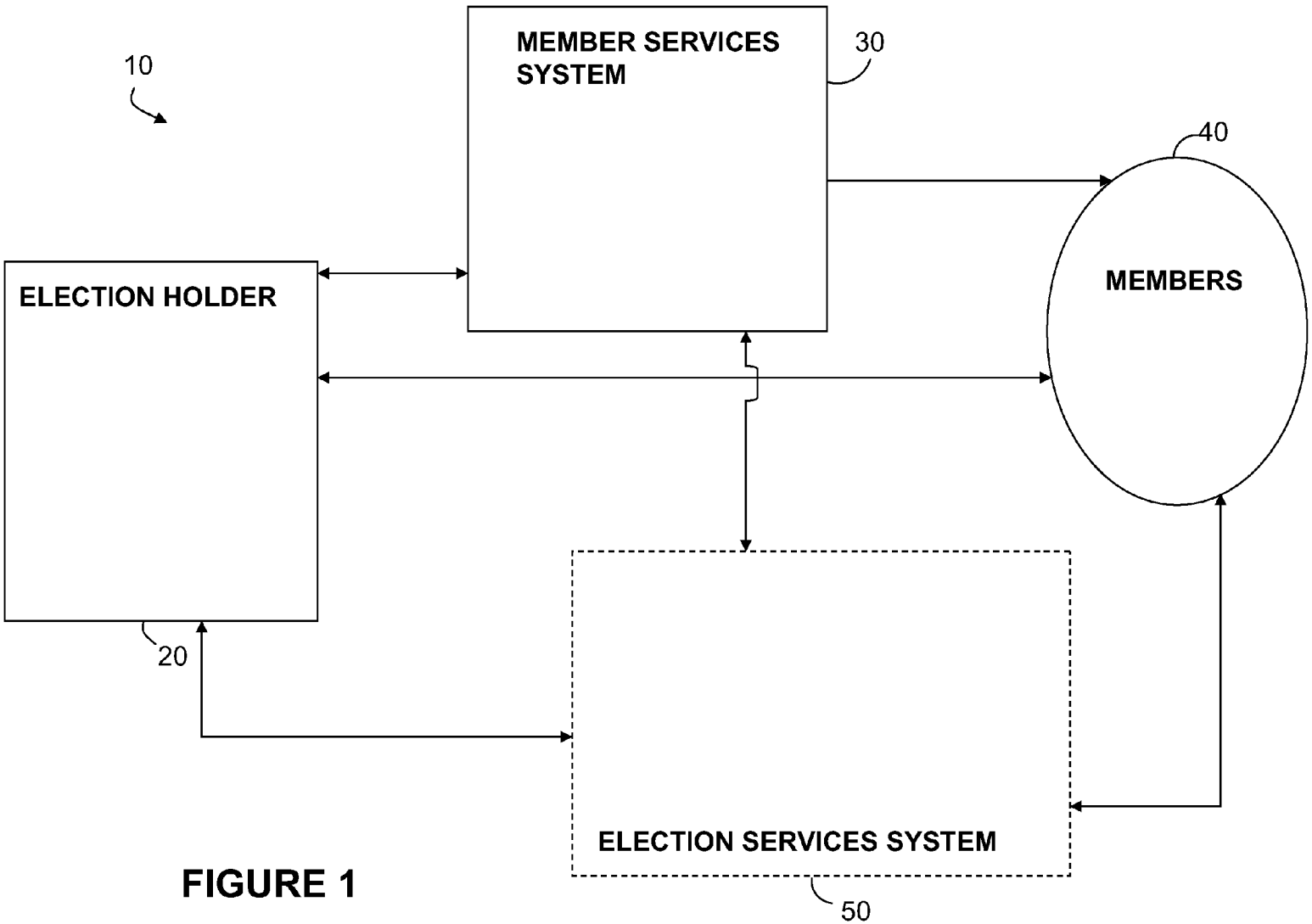
FIG. 1 is a diagram showing exemplary systems forming an election system.

An example election system may implement several components or systems in order to maintain separation of the content of the votes from the identity of the voters. An example election system 10, depicted in FIG. 1, may include a group 20 holding an election, a member services system 30, a plurality of members 40 eligible to vote and an election services system 50.

The group 20 holding the election may be a subset of a larger group that includes the members 40 eligible to vote, or it may be a group of people unaffiliated with a group of members 40 eligible to vote. Individuals within this group may be charged with administering the various components of an election. In some embodiments, the group 20 comprises labor union election officials.

The members 40 eligible to vote may include members of a particular trade union, club, committee, legislature, electorate, or any other set of people that are eligible to vote in an election.

The member services system 30 may control the registration of eligible voters 40. In some embodiments, the member services system 30 is not affiliated with the election services system 50. The member services system 30 may include an organization that acts as an election registrar and may further include a separate sub-organization dedicated to printing election materials and ensuring that those materials are received by the eligible voters 40. The member services system 30 may include or alternatively take the form of, a computer system(s) configured with memory, a processor, and instructions and data stored in memory. The computer system (s) may be in communication with a local or wide-area network, using network communication protocols well-known in the art. The instructions in memory may cause the computer system(s) to function as a registrar and possibly a notification server for the eligible voters 40.

The election services system 50 may host or facilitate the elections by authenticating voters, receiving and storing votes, and preparing voting reports and tallies. The election services system 50 may be an organization that hosts or facilitates elections, and/or a computer system or systems configured with memory, processors, and instructions and data stored in memory. The election services system 50 may be configured to not be capable of linking the content of a vote to the identity of the member 42 who made the vote. Each system will be discussed in greater detail in the following sections.

A. Member Services System

Figure 2:
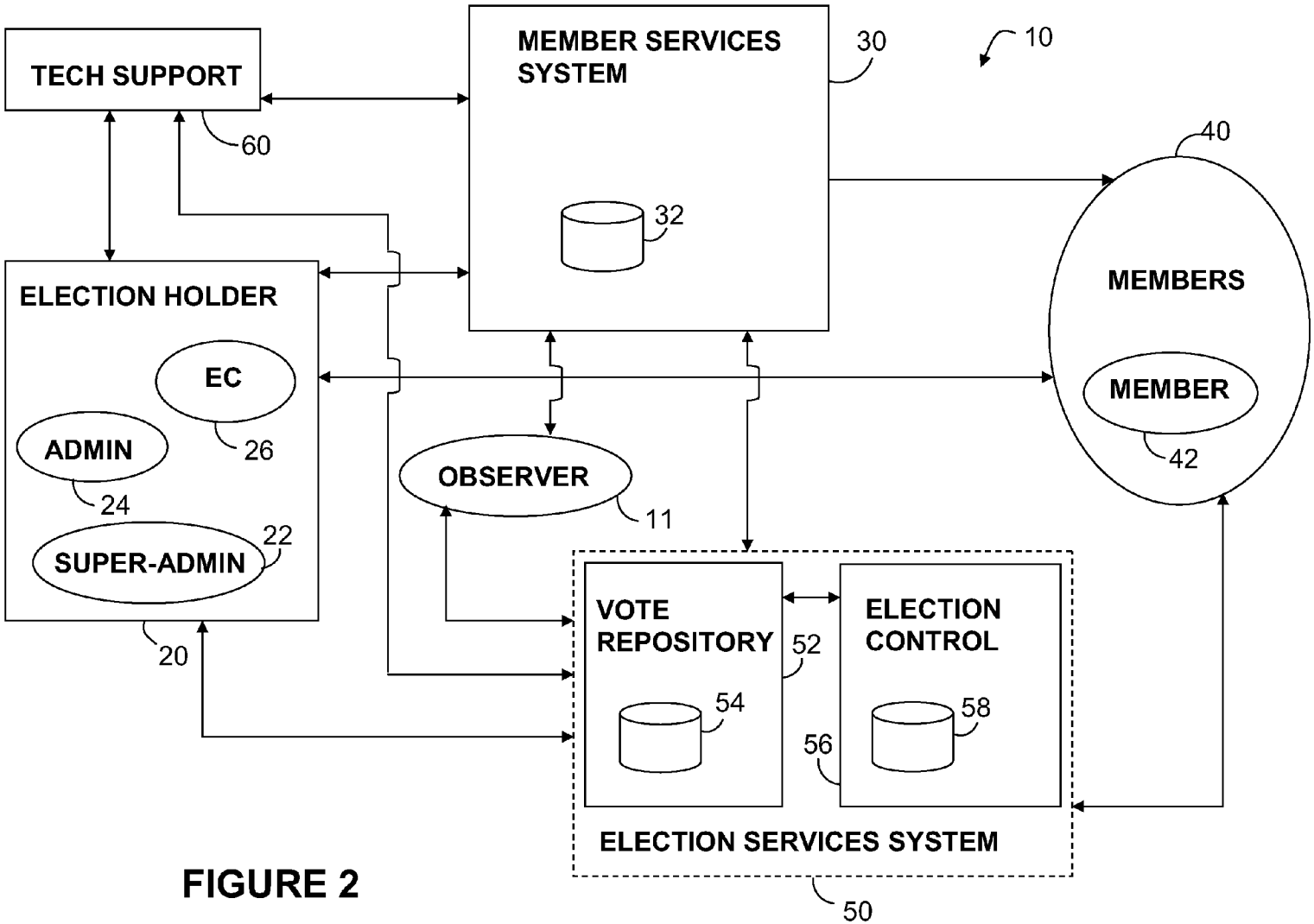
FIG. 2 is a diagram showing an example of the election system of FIG. 1.

As seen in FIG. 2, the member services system 30 may include a database 32 which stores information about the eligible voters 40. For each member 42, the database 32 may include member information such as: a member identification number ("MID"); contact information; a member code ("MC"); an abstract code, possibly related to the MC (hereafter known as an "M-TAG"); and a voter activation code ("VAC"). The database 32 may be configured to not contain the content of the members' 40 votes. FIG. 10A depicts some data that may be stored in database 32.

The MCs, M-TAGs and VACs may be may be any combination of digits, characters or symbols readable by a computer. MCs, which may be unique to each member, may be used by the members to authenticate themselves to the election services system 50, either alone or in combination with the members' PINs. In some embodiments, the MCs may also be used by the member services system 30 and the election services system 50 to refer to members 40. Contact information may include but is not limited to a name, mailing address, telephone number, email address, or any other means by which an individual may be contacted.

M-TAGs may be either random, or mathematically related to or derived from the corresponding MC. The M-TAG may not be known to the member 42, and may be used, instead of or in addition to the MC, by the election services system 50 and the member services system 30 to identify a member 42. In some examples, the M-TAGs may be produced by running the MCs through a mathematical function, which could take the form of any number of algorithms, including but not limited to hash functions (e.g., the SHA-256 or SHA-512 algorithms). Where a hash function is used, the result of the mathematical function may be referred to as a message digest. However they may be produced, M-TAGs may be unique to each member 42.

B. Election Services System

The election services system 50 may take various forms. In one form it may be a single, unified system that conducts the entire election using a single database (not shown). Its data may include but is not limited to members' 40 MCs, M-TAGs, personal identification numbers ("PINs"), vote content, ballot receipts, vote confirmation numbers ("VCN"), and voter attributes. The data shown in FIGS. 10B and 10C, taken together, contain data that may be stored in the election services system's 50 database.

VCNs, which may be generated by the election services system 50, may be used by the members 40 to review their votes. VCNs may be any combination of digits, characters or symbols readable by a computer. Vote content may include the raw data showing how a member voted in an election. In some embodiments vote content may take the form of records in an electronic database. Vote content may be compiled into any number of formats well-known in the art. In examples where voting occurs over the Internet, vote content may be compiled into HTML, XML, or any other format appropriate for distribution over the Internet. In examples where voting occurs over the telephone, vote content may be compiled into a format, such as VXML, that may be audibly communicated to a member 42.

Ballot receipts, which also may be generated by the election services system 50, comprise static documents containing the content of the votes. In one embodiment, ballot receipts take the form of portable document format ("PDF") files containing the vote content. Ballot receipts may be stored in any format impervious to change.

Voter attributes may include specific qualifiers used to determine the eligibility of a member 42 to vote in a particular election, or eligibility to vote on a particular question in a particular election. They may not contain any member identifying information. Voter attributes may be used by the election services system 50 to determine whether an authenticated member 42 may vote in an election. One non-limiting example of a qualifier that may be used to determine the eligibility of a member 42 to vote in an election is whether the member 42 has paid her dues to the group 20 holding the election.

In other examples, the election services system 50 comprises two or more systems. Such embodiments may include a vote repository system 52 having its own database 54 and an election control system 56 having its own database 58. The vote repository system 52 may store in its database 54 the contents of votes, unique ballot identification numbers and temporary identification numbers (hereafter referred to "B-TAGs" and "T-TAGS", respectively) associated with those votes, and the VCNs. The vote repository system may also be charged with generating ballot receipts and VCNs. FIG. 10C shows one example of data that may be stored in database 54.

The election control system 56 may not store vote content or ballot receipts, but may store in its database 58 the unique B-TAGs and T-TAGs corresponding to each vote, the M-TAGs associated with the members, and the voter attributes associated with each M-TAG.

B-TAGs and T-TAGs may be any combination of digits, characters or symbols readable by a computer. These values may be used by the election control system 56 and the vote repository system 52 to identify individual votes. In this example, databases 54 and 58 do not contain data that will allow the vote content to be connected with the identity of the voter.

The election control system 56 may be charged with authenticating voters 40. In such cases, the election control system 56 may store in its database 58 the result of a mathematical function of the combination of the voters' member codes and PINs used to log in to the system (this result will hereafter be referred to as the "L-TAG"). As with the previously mentioned mathematical function, this mathematical function may take the form of any number of algorithms, including but not limited to hash functions. After storing the L-TAGs created with the MCs and PINs, the election control system 56 may discard the individual MCs and PINs. Discarding these values virtually eliminates the possibility of an intruder discovering a member's MC or PIN, even if the intruder acquires the L-TAG.

FIG. 10B shows one possible database table showing data, including the L-TAG, which may be stored in database 58. In some embodiments, the B-TAG stored in the vote repository system database 54 may be an altered form of the B-TAG stored in the election control system database 58, providing an additional level of protection against the association of vote content to the voter's identity.

While a database used in any of the above systems may be a computer database, it should be understood that other means of storing data may be implemented.

The systems and people involved may communicate among one another using numerous communication links, including but not limited to telephone, email, US Mail, communication over a computer network using a client-server computing model, oral, or any other method of conveying information. A computer network connecting some example systems may be a local area network or the Internet. It should be understood, therefore, that any forthcoming mention of communicating, notifying, requesting, acquiring and authenticating may transpire over any of the aforementioned communication links. In some examples, the communication links may be made secure by requiring communication over predetermined, limited communication links, encryption, digital certificate validation, or other methods.

II. Administrative Access

Referring to FIG. 2, various components of the election system 10 may be controlled by various individuals, known as administrators. There may be multiple levels of administrators, such as super administrators 22, general administrators 24 and election chairs 26 (referred to in FIG. 2 as "EC"). Administrators 24 may have access to various systems of the election system 10. Super administrators 22, in contrast, may not have access to components of the system 10, but instead may have the power to designate individuals as administrators 24.

There may be multiple types of administrators 24, and each type may have access to different parts of the election system 10. One type of administrator 24 is a member services system administrator 24 (hereafter referred to as "MSS-ADMIN"). These individuals may have access to the information contained within the member services system 30, such as the data contained in database 32.

Another type of administrator 24 is an election services system administrator (hereafter referred to as "ESS-ADMIN"). These individuals may have access to the information contained within the election services system 50. In embodiments where the election services system 50 is a single system, an ESS-ADMIN 24 may have access to at least some data in the election services system's database, such a database formed by the combination of databases 54 and 58.

In embodiments where the election services system 50 includes a vote repository system 52 and an election control system 56, an ESS-ADMIN 24 may have access to at least some of the data in the election control system's database 58, but not the B-TAGS. In this case, the ESS-ADMIN 24 may not have access to data in the vote repository system 52.

A third type of administrator 24 is a vote repository system administrator (hereafter referred to as "VR-ADMIN"). A VR-ADMIN 24 may have access to group data in database 54 in the aggregate, such as ballot receipts, but not the B-TAGS associated with votes. Hence, in a dual system, the ESS-ADMIN 24 may not have the same access rights as the VR-ADMIN 24.

Figure 3A:
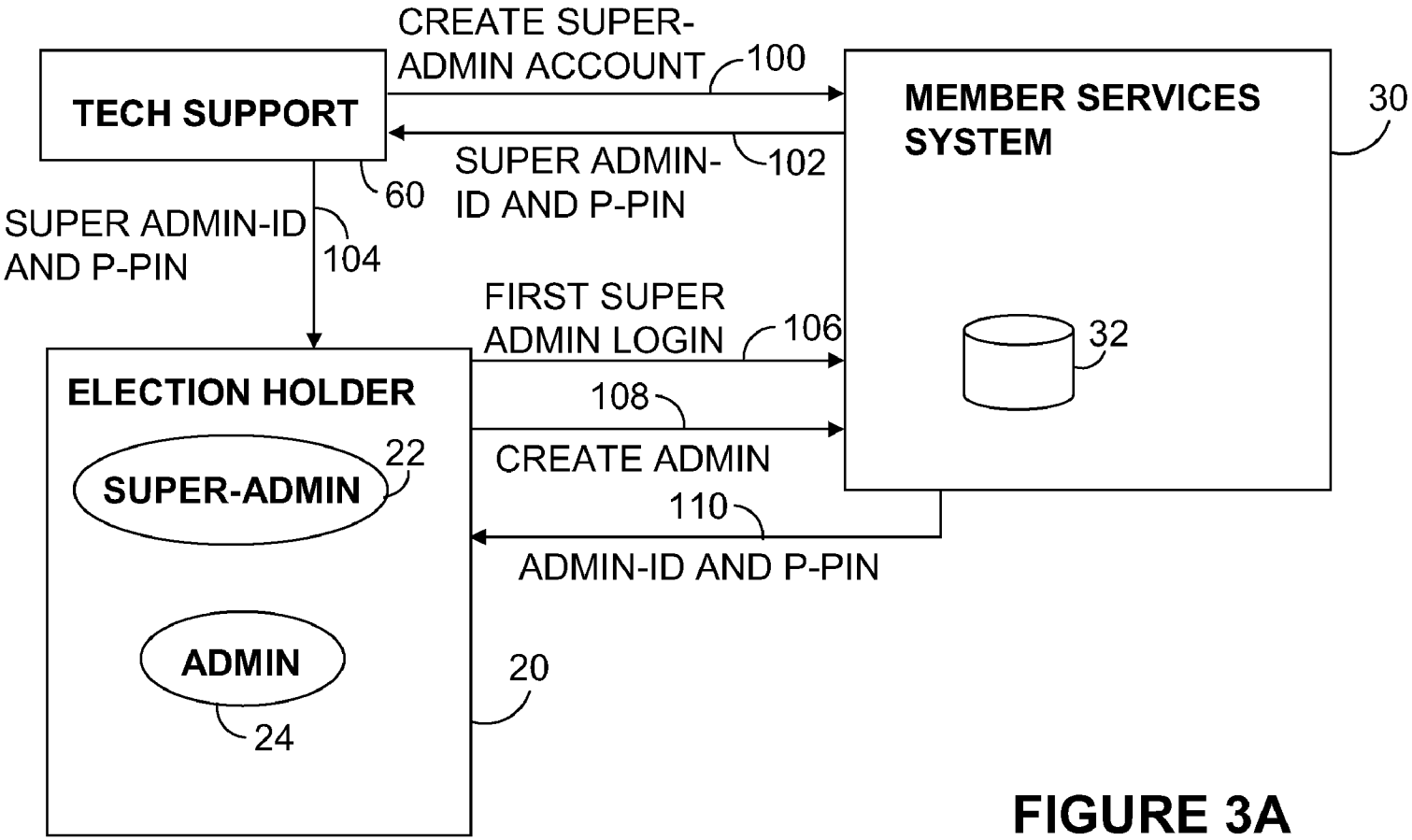
FIGS. 3A-D show example processes for creating various administrative accounts in the election system of FIG. 2.
Figure 3B:
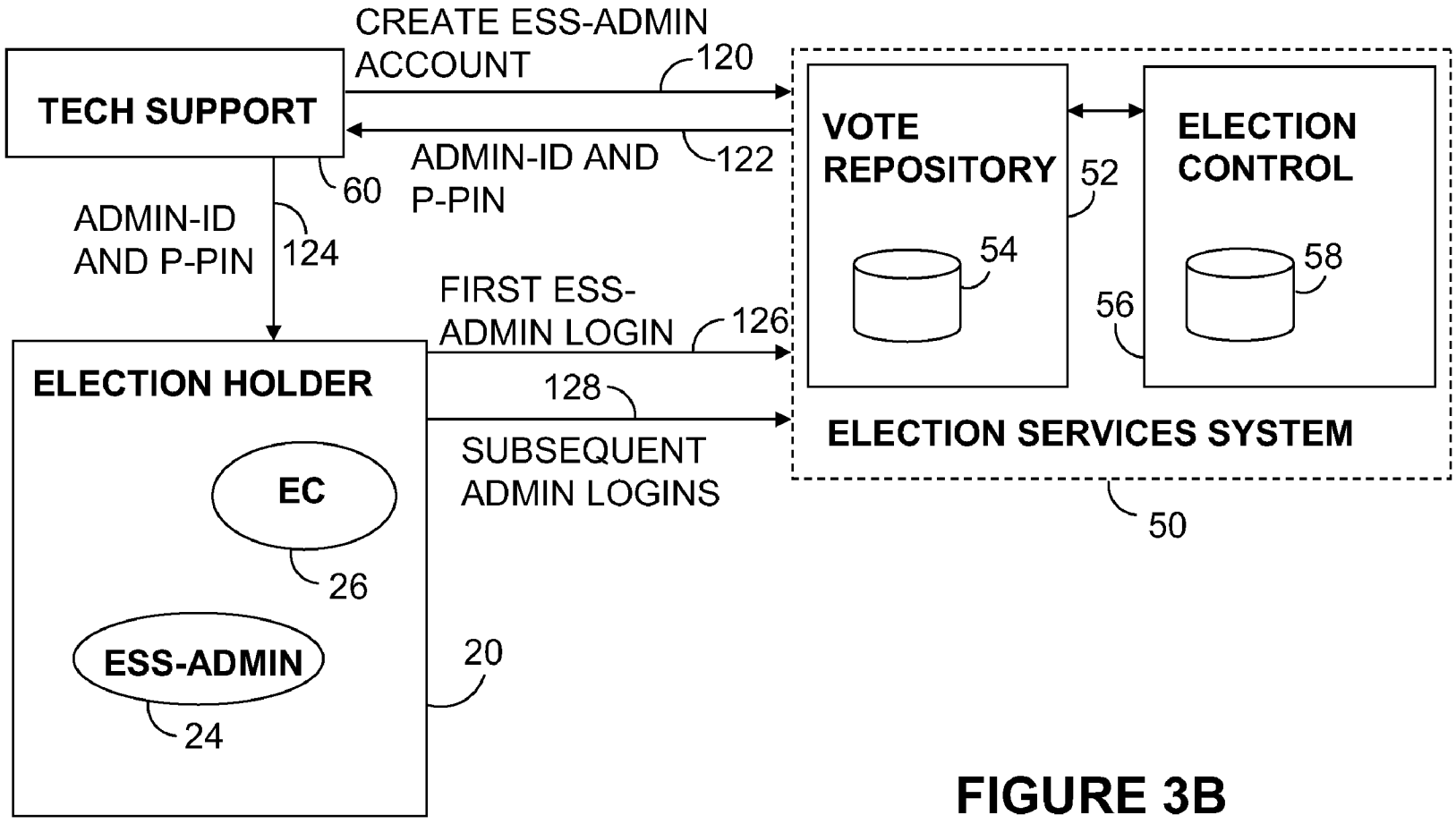

Administrators 24 and super administrators 22 may be created by various entities. For example, super administrator 22 accounts may be created by an election technical support 60 ("election tech support"), as shown in FIG. 3A. The election tech support 60 may also create ESS-ADMIN accounts, as seen in FIG. 3B.

The election tech support 60 may be affiliated with the member services system 30, the election services system 50, or may be unaffiliated with either.

FIG. 3A depicts one possible process of setting up a super administrator account on election system 10. In step 100 election tech support 60 logs into the member services system 30 and creates a super administrator account. The member services system 30 returns to the tech support 60 an administrative identification number ("ADMIN-ID") and a provisional personal identification number ("P-PIN") in step 102. The election tech support 60 then communicates the ADMIN-ID and P-PIN to the designated super administrator 22 in step 104.

The first time the super administrator 22 communicates with the member services system 30 in step 106, the super administrator 22 may be required to furnish the ADMIN-ID and P-PIN. The member services system 30 may then require the super administrator 22 to choose a PIN to replace the P-PIN for use on subsequent communications 108 with the member services system 30.

In step 108, the super administrator 22 may designate one or more administrators 24 by communicating the name and administrative attributes for each administrator 24 to the member services system 30. The system 30 generates and returns unique ADMIN-IDs and P-PINs for each administrator 24 in step 110. The super administrator 22 may communicate these ADMIN-IDs and P-PINs to the administrators 24.

While FIG. 3A only shows the member services system 30, it should be understood that a process similar to the one depicted may be used to create VR-ADMINs. In such a process, the main difference is that the communications are with the vote repository system 52, instead of the member services system 30.

Once the super administrator account is created, the election tech support 60 may thereafter be barred from accessing critical information that could be used to link voter identities to vote content. It should be understood that the super administrator 22 authorized to designate MSS-ADMINs may be the same or a different individual than the super administrator 22 authorized to designate VR-ADMINs.

Figure 3C:
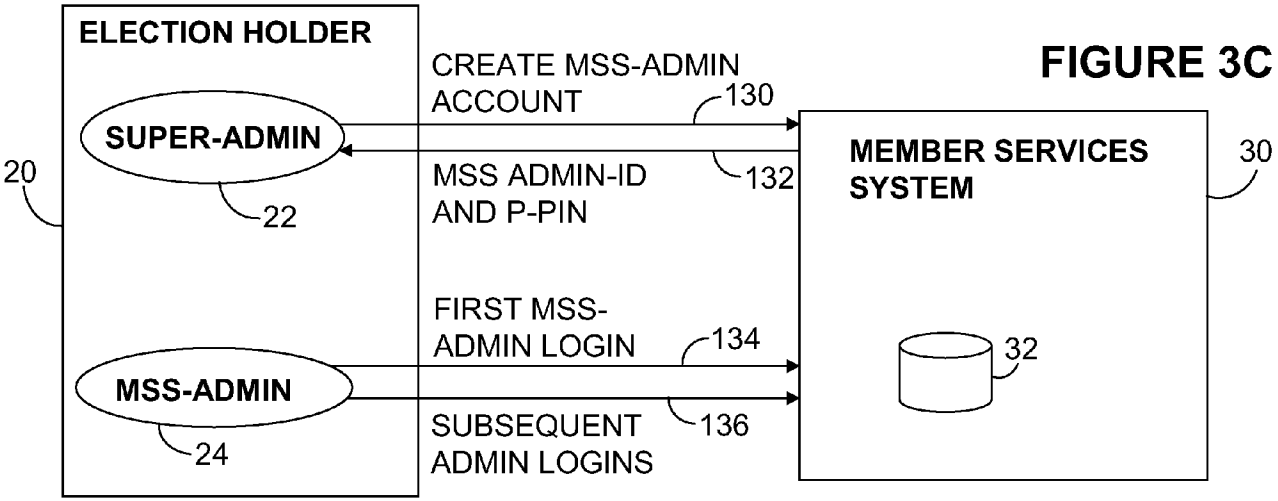
Figure 3D:
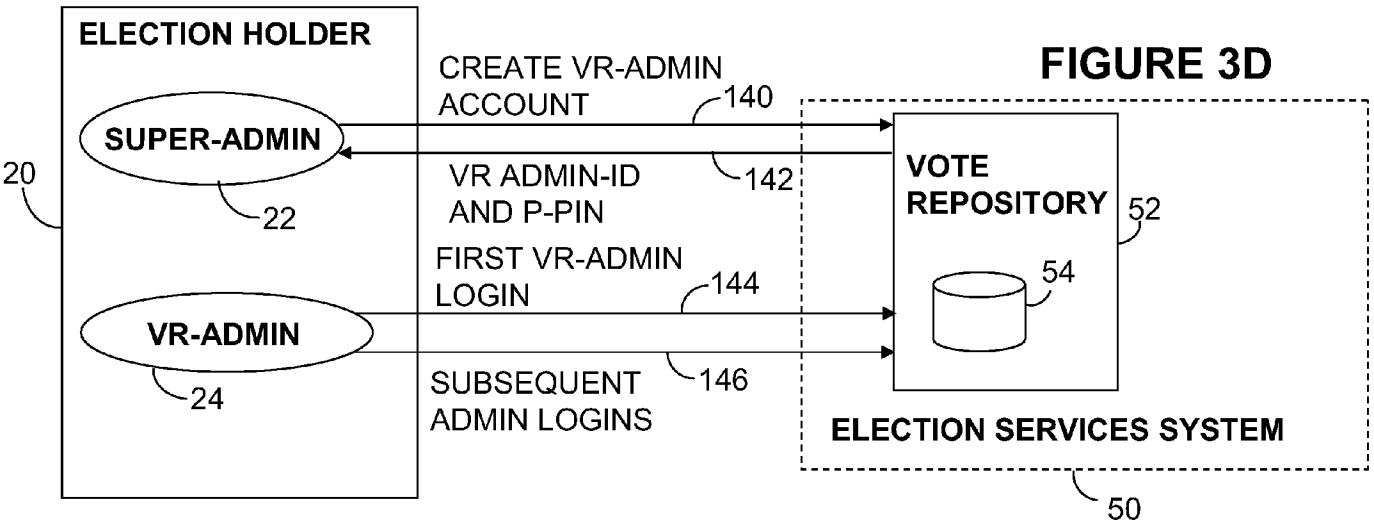

The task of creating other types of administrators 24 may be assigned to the super administrator(s) 22. As seen in FIGS. 3C and 3D, super administrators 22 may designate MSS-ADMINs and VR-ADMINs, thus allowing the group 20 holding the election direct control of whom may adopt these roles.

FIG. 3B shows an example process of creating an ESS-ADMIN 24 for the election services system 50. Election tech support 60 may log into the election services system 50 (or the election control system 56 in some embodiments) and create an ESS-ADMIN account in step 120. In step 122, the election services system 50 (or the election control system 56) returns to the election tech support 60 an ADMIN-ID and P-PIN, which the election tech support 60 communicates to the ESS-ADMIN in step 124. The ESS-ADMIN logs into the election services system 50 in step 126, and may be required to submit a PIN of the ESS-ADMIN's choosing to replace the P-PIN. In subsequent logins 128, the ESS-ADMIN may be required to furnish her ADMIN-ID and PIN to gain access.

FIGS. 3C and 3D show processes for the creation of MSS-ADMIN and VR-ADMIN accounts. Turning to FIG. 3C, a super administrator 22 logs into the member services system 30 and designates an individual as an MSS-ADMIN 24 in step 130. The member services system 30 returns an ADMIN-ID and a P-PIN in step 132, which the super administrator 22 may communicate to the designated MSS-ADMIN 24. The MSS-ADMIN 24 may log into the member services system 30 in step 134 using the ADMIN-ID and P-PIN, and she may be required to replace the P-PIN with a PIN of her choosing. In subsequent logins 136, the MSS-ADMIN 24 may log in using her ADMIN-ID and PIN.

Turning to FIG. 3D, a super administrator 22 logs into the vote repository system 52 and designates an individual as a VR-ADMIN in step 140. The vote repository system 52 returns an ADMIN-ID and a P-PIN in step 142, which the super administrator 22 may communicate to the designated VR-ADMIN 24. The VR-ADMIN 24 may log into the vote repository system 52 in step 144 using the ADMIN-ID and P-PIN, and she may be required to replace the P-PIN with a PIN of her choosing. In subsequent logins 146, the VR-ADMIN 24 may be required to log in using her ADMIN-ID and PIN.

Activity conducted by an administrator 24, or anyone else, on the election services system 50, election control system 56, member services system 30 or vote repository system 52 may be logged. Election observers 11 may be permitted to view some or all of these logs.

III. The Election Process

Figure 4A:
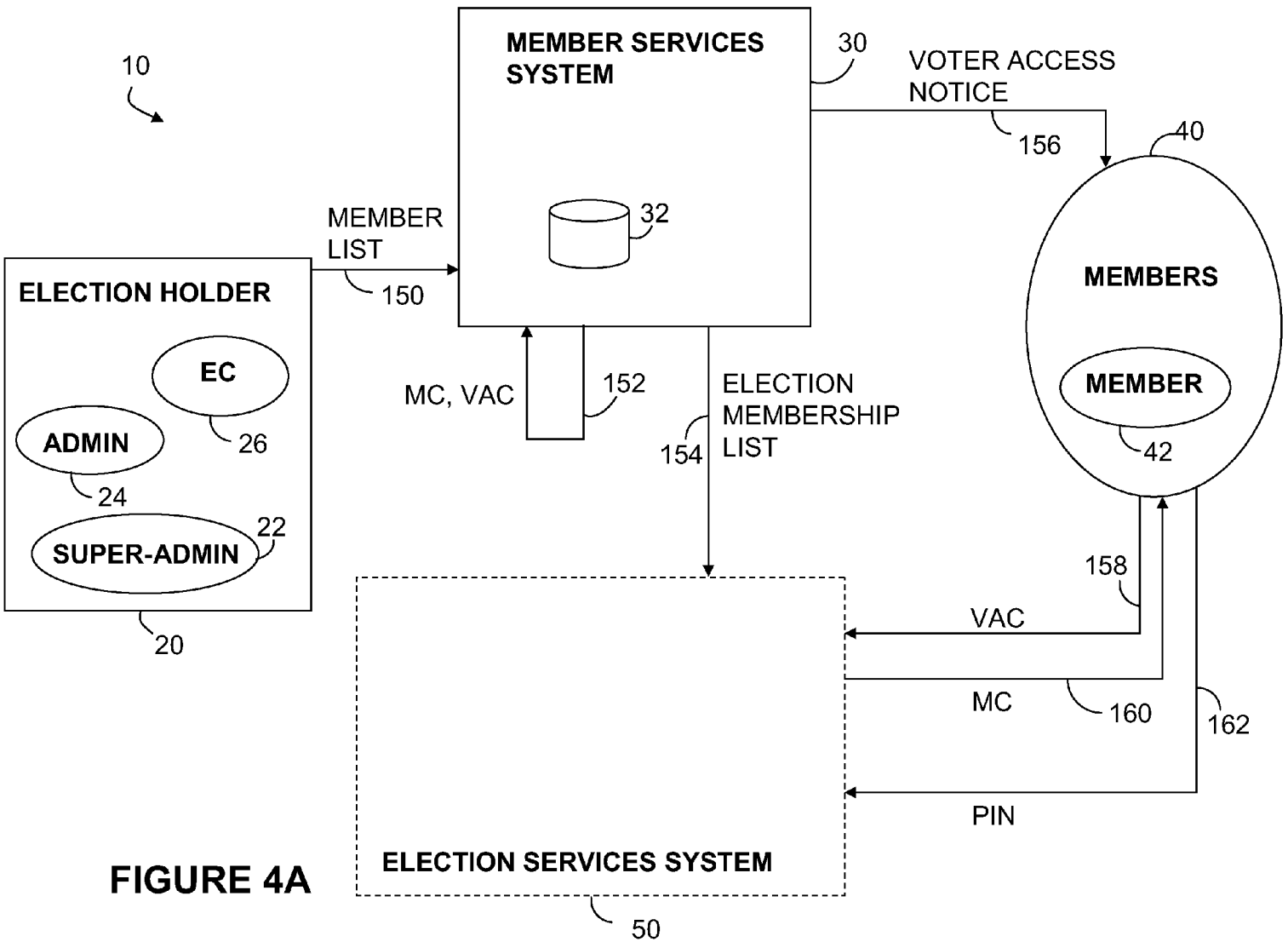
FIGS. 4A-B show example processes of the election system of FIG. 2 for compiling a list of eligible voters, notifying those voters of an impending election, and allowing the voters to activate their election accounts.

Prior to an election, an MSS-ADMIN 24 may communicate a list of members 40 eligible to vote in the election to the member services system 30, and the members 40 eligible to vote may be given notice of the election and instructions describing how to access the election services system 50. FIG. 4A illustrates one possible process that may be used to accomplish this task, as well as activating voter accounts.

In step 150 MSS-ADMIN 24 authenticates herself to the member services system 30 using her ADMIN-ID and PIN and communicates a membership list to the member services system 30. This membership list may include eligible members' 40 contact information (e.g., name, address, telephone number), MID, and voter attributes. Next, in step 152, the member services system 30 may generate and store MCs and VACs for the members 40 eligible to vote.

In step 154, the member services system 30 sends an election membership list to the election services system 50. The election membership list may include one or more of a MC, VAC, and voter attributes for each member. The election membership list may not include member-identifying information such as the member's name, contact information, or any other similar information. In some embodiments the member services system 30 may discard the voter attributes after sending them to the election services system 50.

The member services system 30 also may send voter access notices to the eligible members 40 in step 156. Voter access notices 156 may include a VAC which a member 42 may be required to use the first time she logs in to the election services system 50. After using the VAC the member 42 may be required by the election services system 50 to choose a PIN for use thereafter.

The voter access notices 156 alternatively could include a member's MC and a P-PIN. In this case the election services system 50 would be configured to receive the member's MC and P-PIN the first time the member 42 logs in, and the election services system 50 may require the member to choose a PIN to use instead of the P-PIN from that point forward. In such an embodiment, a specific MC may only be sent to each member once. If the member 42 loses her MC, the member services system 30 may generate a new MC to send to the election services system 50 and, optionally, the member in a subsequent voter access notification.

Referring back to FIG. 4A, to access the election services system 50 the first time, a member 42 may communicate her valid VAC to the election services system 50 in step 158. The election services system 50 may respond with the member's MC and a request for the member 40 to choose her PIN in step 160. The election services system 50 may thereafter prohibit access to anyone attempting to gain access using that VAC. In another embodiment, the member 42 may communicate her valid MC and P-PIN to the election services system 50, which may respond with a request for the member to change her PIN. In either case, the member 42 may now choose a PIN in step 162.

Figure 4B:
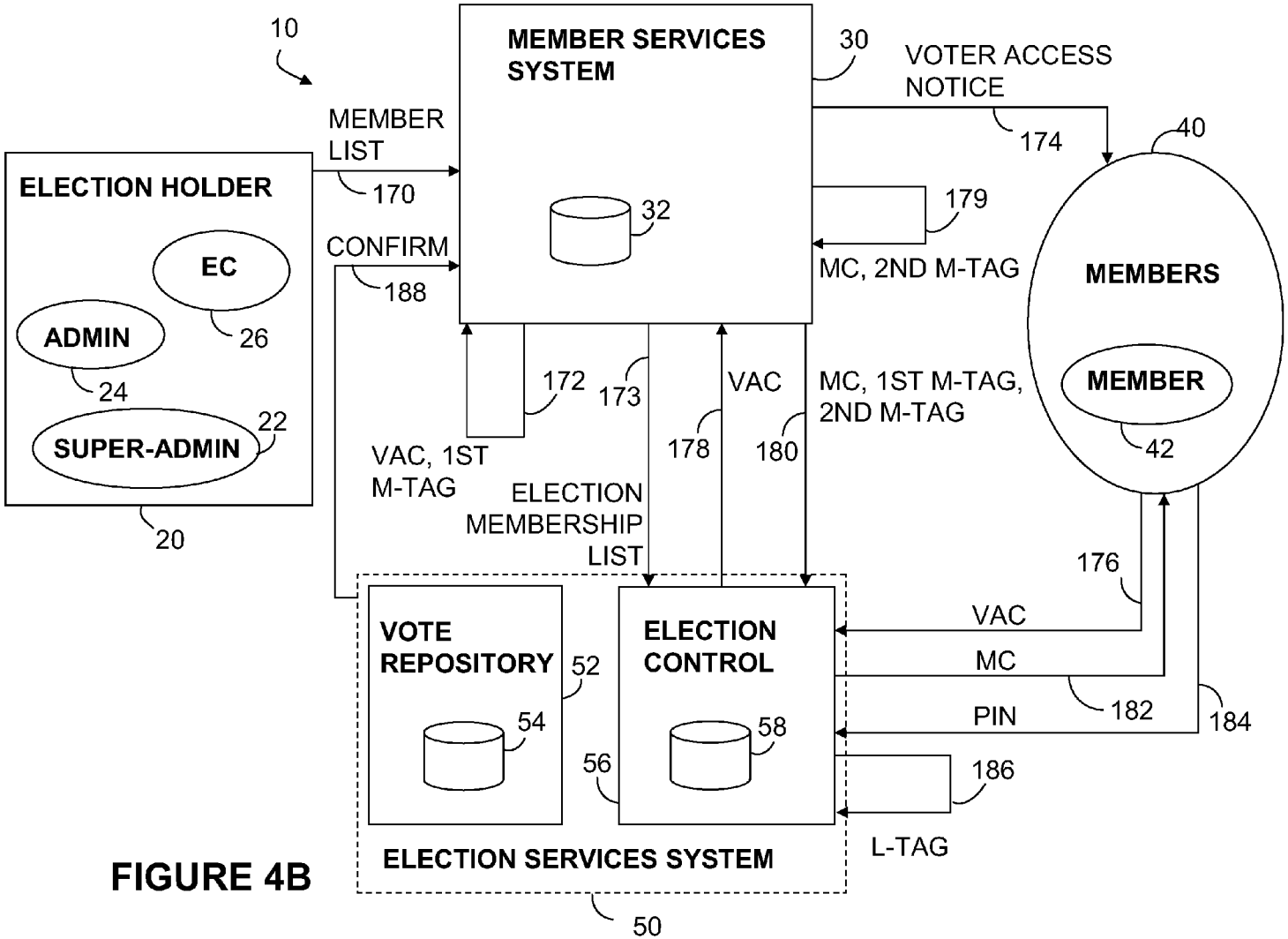

In another embodiment, depicted in FIG. 4B, the tasks of notifying members of an election and activating member voting accounts may be performed in a manner that prevents the election services system 50 from storing VACs, MCs or PINs (i.e. credentials used by the member 42). In this example, the election services system 50 comprises a vote repository system 52 and an election control system 56, as described previously. However, the process shown in FIG. 4B may be used in an embodiment where the election services system 50 is a single unified system.

In step 170, similar to step 150 of FIG. 4A, a member list may be communicated from the group 20 holding the election to the member services system 30. In step 172, the member services system 30 generates and stores a VAC and first M-TAG for each member in the list.

In this embodiment MCs and VACs are never stored anywhere on the election services system 50. Instead, the member services system 30 sends an election member list containing the first M-TAGs and associated voter attributes in step 173, and then communicates voter access notices containing VACs to the eligible voting members in step 174 (similar to step 156 of FIG. 4A). The election control system 56 then waits for a voting member 42 to attempt to log in for the first time.

The first time a member 42 logs into the election control system 56 in step 176, she may be required to provide her VAC. In step 178, the election control system 56 may relay the VAC (without storing it in its database 58) to the member services system 30. In step 179, the member services system generates an MC and a second M-TAG, and stores the second M-TAG. In step 180, the member services system 30 returns the member's MC and second M-TAG to the election control system 56. At this point, in some embodiments the member services system 30 may discard the MC. The election control system 56 stores the second M-TAG, but instead of storing the MC, the system 56 relays it to the member 42 in step 182. After receiving an MC, the member 42 may be required to provide a PIN to the election control system 56 in step 184. In step 186, the election control system 56 may create and store the L-TAG, as described in greater detail above, and may discard the MC and PIN. In step 188, the election services system 50 may communicate a message to the member services system 30 containing the second M-TAG and confirmation that the member 42 has activated her account. Once this message is sent, the member services system 30 and/or the election services system 50 may discard the first M-TAG.

In some cases a member may have never received a VAC, or the VAC may have had an expiration date that passed before the member 42 used it. In other cases, there may be suspected or verified compromise of the member's 42 PIN or MC. In all such cases it may be necessary to assign the member 42 a new VAC (or MC and P-PIN). If a member 42 should lose either her MC or PIN, the group 20 holding the election, the member services system 30 and the election services system 50 may work together to provide the member 42 with a replacement VAC without forfeiting any votes the member 42 may have already cast.

Figure 5:
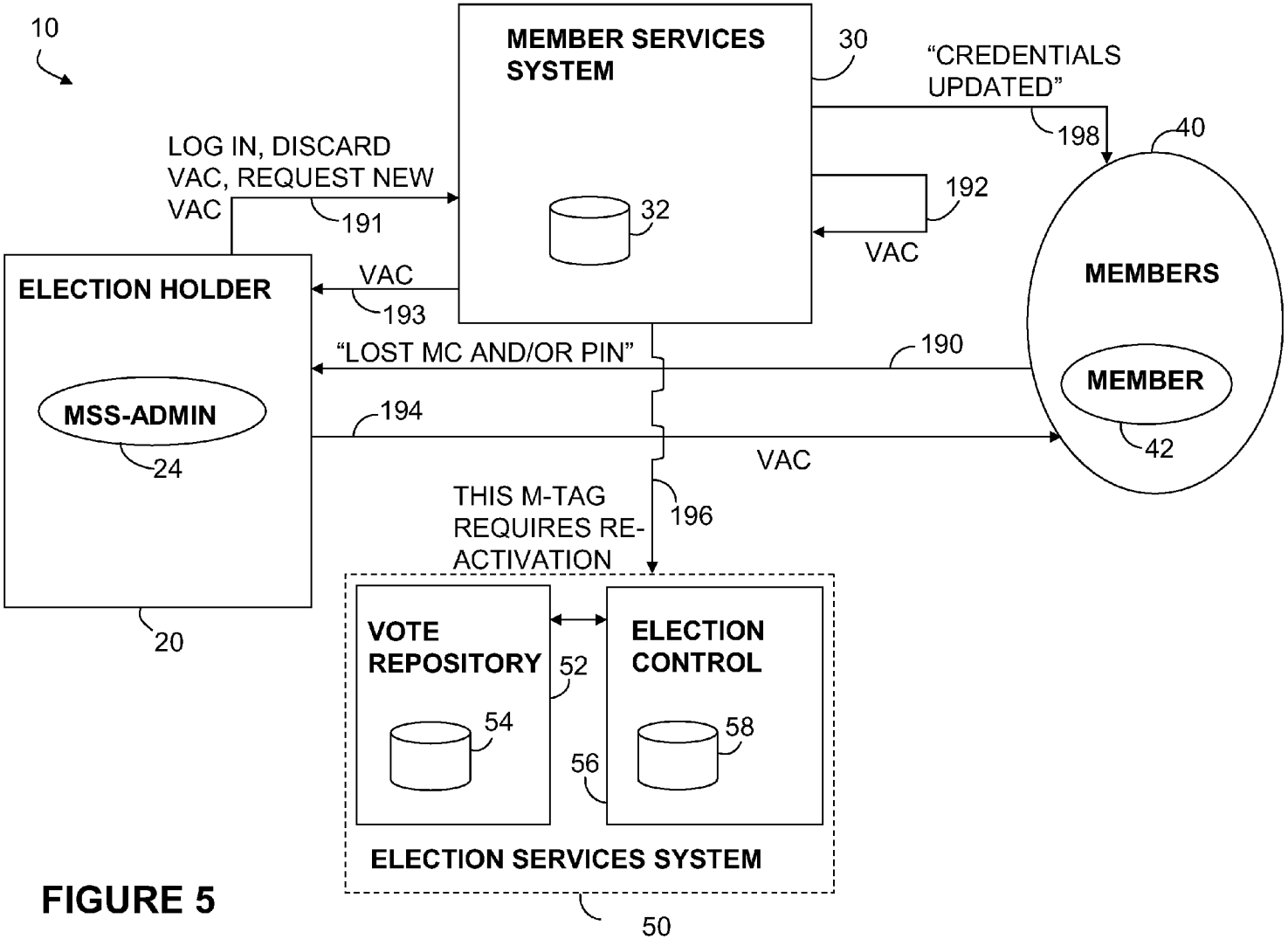
FIG. 5 is a diagram showing an example process of the election system of FIG. 2 for replacing an eligible voter's lost member code and personal identification number.

Referring now to FIG. 5, a member 42 notifies the group 20 holding an election that she has lost her MC and/or PIN in step 190. In step 191, an MSS-ADMIN 24 authenticates herself to the member services system 30 and requests a new VAC for the member 42, which the member services system 30 generates in step 192, and returns to the MSS-ADMIN in step 193.

In step 194, the MSS-ADMIN 24 gives the new VAC to the member. In step 196 the member services system 30 communicates a request to the election services system 50 to require the member 42 to use the new VAC to log in to the election services system in the future. In some embodiments, this request may also include an updated MC with which the election services system 50 or election control system 56 may associate with the member's voter attributes and any votes already cast by the member. In step 198, the member services system 30 may notify the member that her credentials have been updated.

Figure 6:
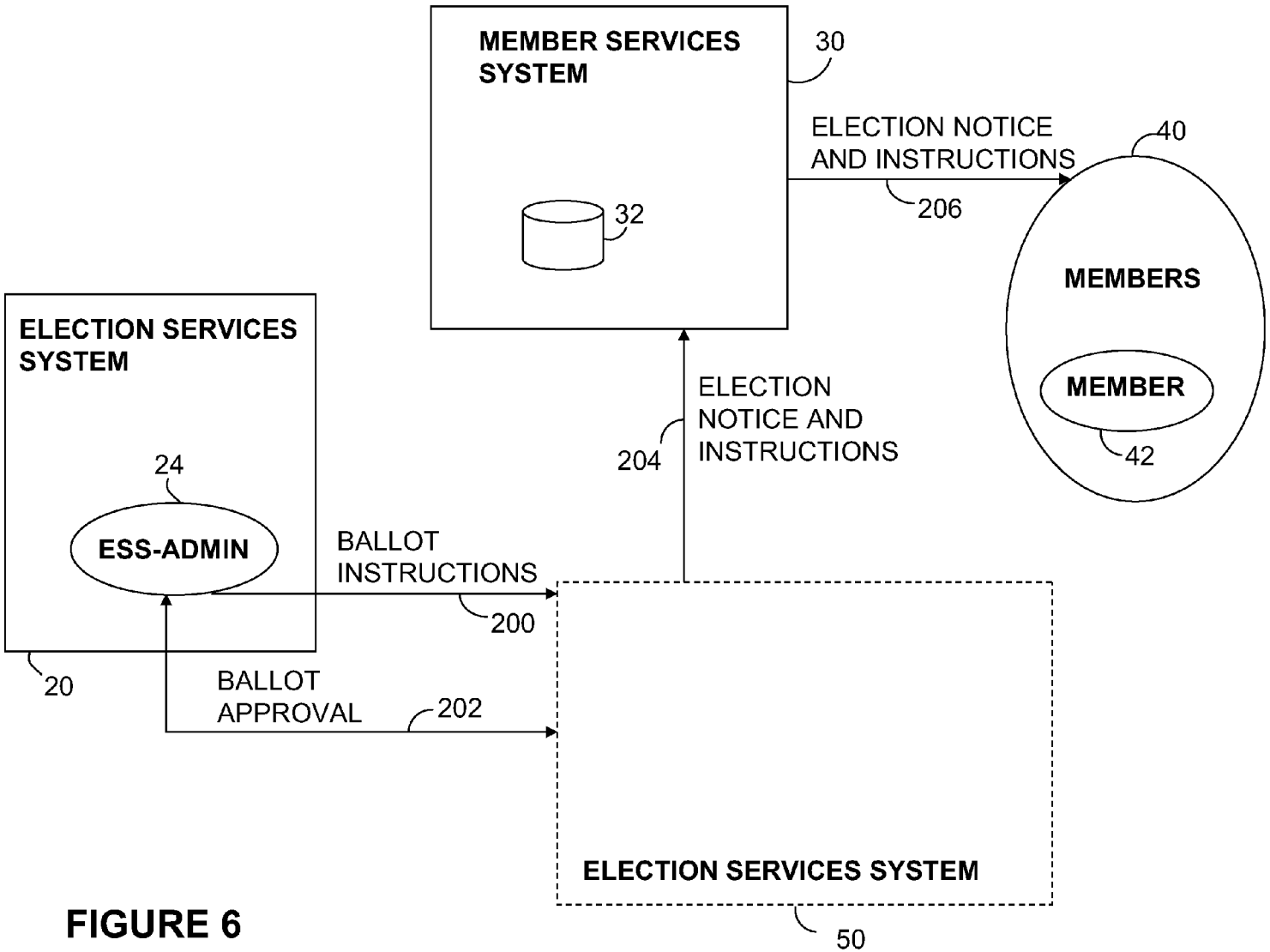
FIG. 6 shows an example process of the election system of FIG. 2 for creating a ballot and communicating the ballot and voting instructions to eligible voters.

When a group 20 holding an election wishes to initiate the election, they may create a ballot and send a notice and instructions to the voting members 40. FIG. 6 shows a method that may be implemented in various embodiments. In an embodiment shown in FIG. 6, the ESS-ADMIN 24 may authenticate herself with the election services system 50 and communicate instructions to create a ballot to the election services system 50 in step 200. Ballot instructions may include but are not limited to the name of the election, ballot questions, allowable answers and qualifying attributes for voters for that election.

In one non-limiting example, the ESS-ADMIN 24 may use a word processor-based (e.g., Microsoft Word®) template with built-in macros that facilitate the layout of a ballot. When filled out with the information that will appear on a ballot, the resulting macro-processed document may be termed the "ballot definition." The ballot definition may also contain election rules to which voter attributes may be compared, in order to determine whether a voter is authorized to vote in a particular election or on a particular question in an election. The ballot definition may be converted into a form that may be uploaded to the election services system 50. In embodiments where members 40 will vote using a telephone, an administrator 24 may record phrases that may be spoken to the members 40 before voting.

In step 202, the election services system 50 generates a ballot based on the received ballot instructions, and the ESS-ADMIN 24 may review this ballot in the same format that the ballot will be delivered to the members 40 (e.g., telephonically or via a webpage).

Once the ballot definition is approved in step 202, the election services system 50 may communicate an election member list containing the MCs or M-TAGs of members 40 eligible to vote in the election to the member services system 30 in step 204. The eligibility of members may be determined by election services system 50 based on voter attributes. In step 206, the member services system 30 may generate and send to the members identified in the election member list an election notice and instructions.

An example voting process may include the following steps: a member 42 inputs her vote; that input is compiled into a ballot receipt and stored (either in the election services system's 50 database or the vote repository database 54); the ballot receipt, as stored, is displayed (or played audibly) to the member 42; and the member 42 approves or disapproves the vote. This sequence ensures that the vote that is tallied after the election is the same vote that the member 42 approved during the election.

Figure 7A:
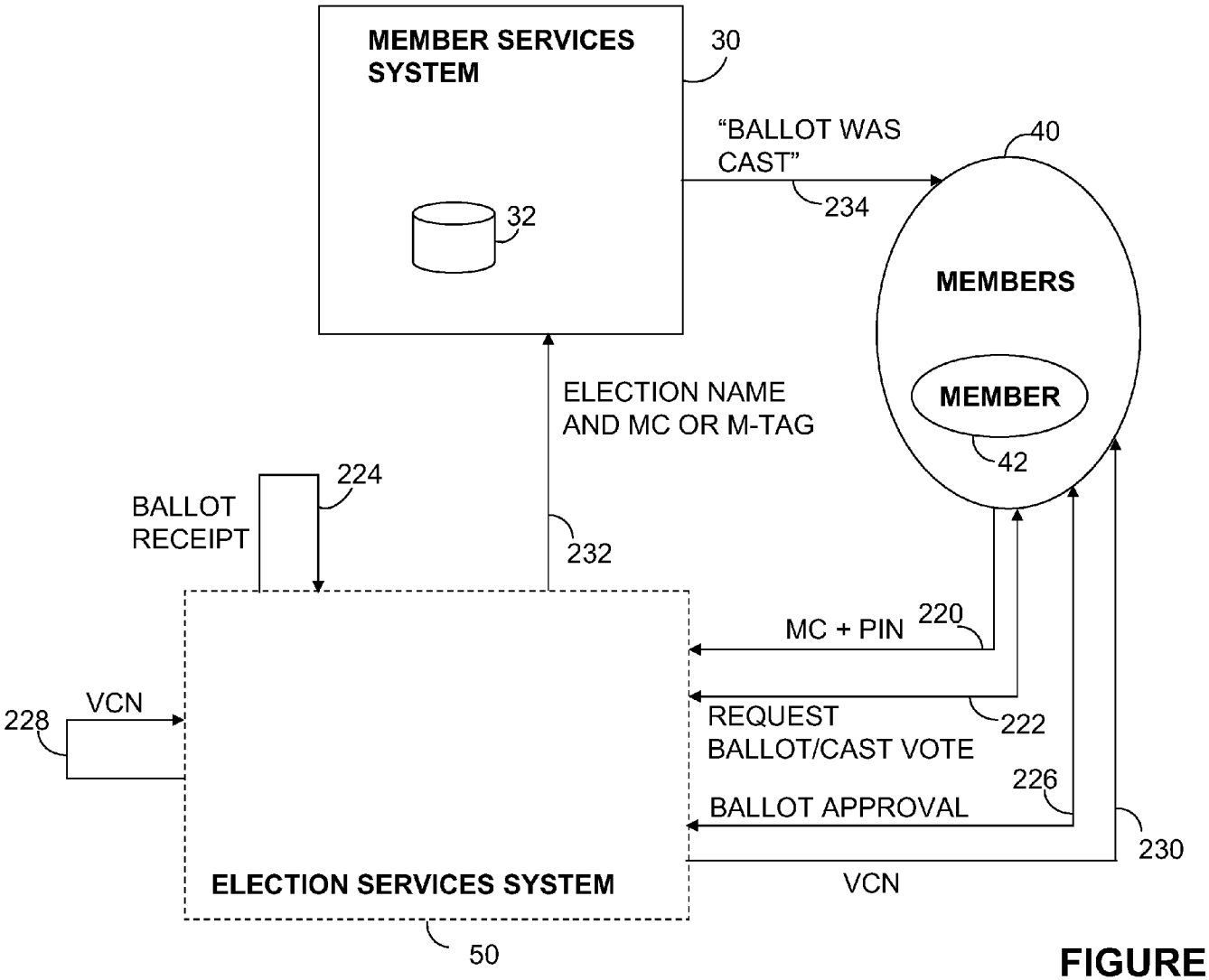
FIGS. 7A-B show an example process of the election system of FIG. 2, at two levels of detail, for voting.
Figure 7B:
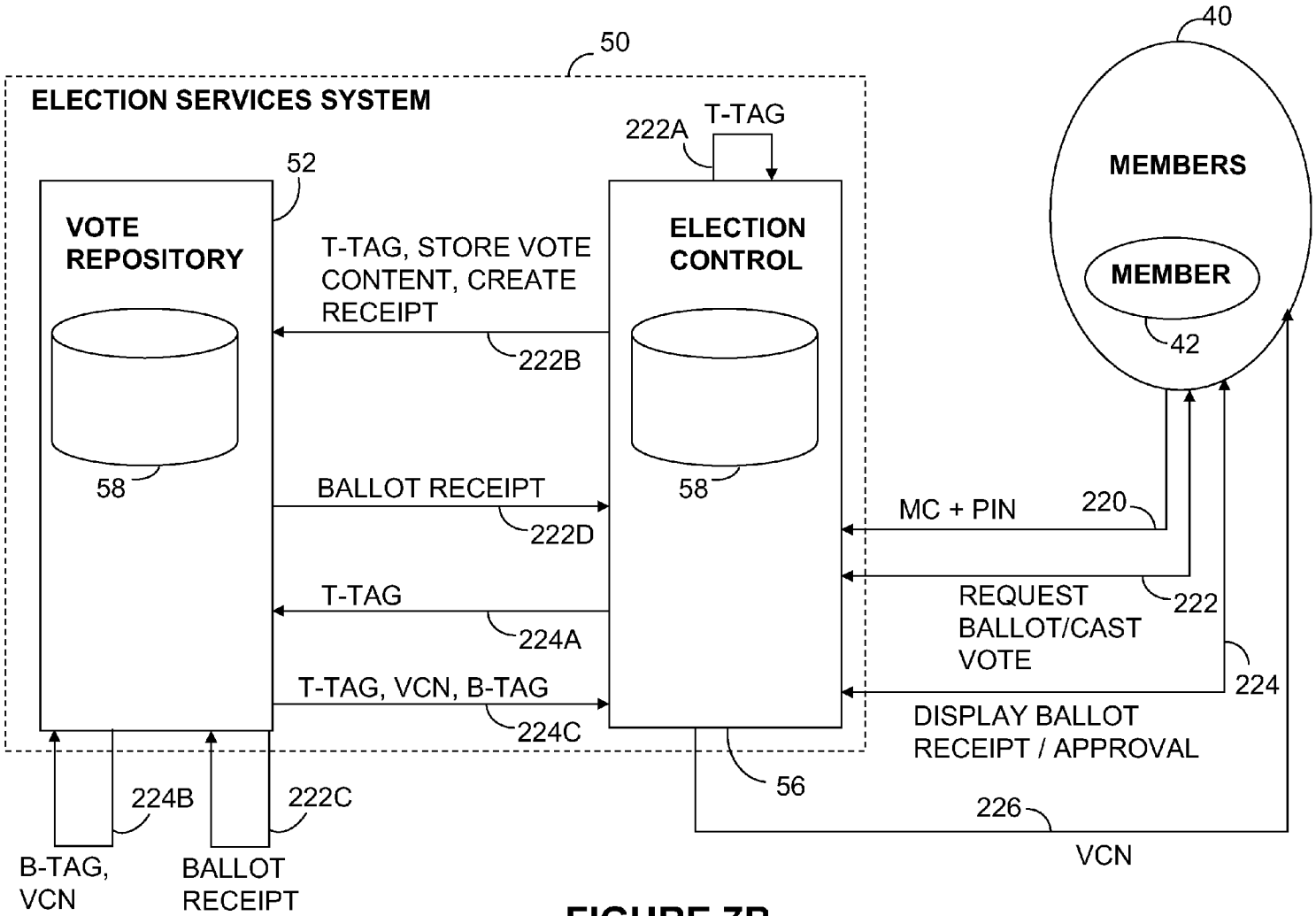

Example voting processes are depicted in FIGS. 7A and 7B. Referring to FIG. 7A, a voting member 42 communicates her MC and PIN to the election services system 50 in step 220, which authenticates the voting member's MC and PIN in order to continue with the voting process. Once authenticated, in step 222 the voting member 42 requests a ballot and casts her vote. Ballots may be cast using various methods, including but not limited to over the telephone or over the Internet.

In step 224, the election services system 50 generates a ballot receipt and stores it, along with the vote content, in its database. In step 226 the election services system 50 displays (or audibly plays) the ballot receipt to the member, so that the member 42 may approve the ballot exactly as it is stored. Once the member 42 approves the ballot receipt, the election services system 50 generates a VCN in step 228, which it associates with the received ballot. The election services system 50 may send the VCN to the voting member 42 in step 230, as confirmation that the election services system 50 received the voting member's vote. This VCN may not be known to the member services system 30, and for that reason, it may be used to verify a vote that is known only to the election services system 50 and the voting member 42. The voting member 42 may also use the VCN in conjunction with her MC and PIN to change her vote, assuming the election is not yet completed and voters 40 are allowed to change their votes.

In step 232, the election services system 50 may communicate to the member services system 30 the name of the election and the voting member's M-TAG (or MC, depending on the embodiment). The member services system 30 may then use the contact information associated with the voting member's M-TAG (or MC) in database 32 to notify the member that her vote was cast in step 234.

FIG. 7B depicts a detailed view of one possible embodiment of the process shown in FIG. 7A, where the election services system 50 comprises a vote repository system 52 and an election control system 56. Similar as before, in step 220 a member 42 communicates her MC and PIN to the election services system 50. In this embodiment, however, the communication goes to the election control system 56, which authenticates the member 42 by performing the same mathematical function using the combination of the MC and PIN that it performed when the member 42 activated her account previously, and comparing the result to the stored L-TAG. Once authenticated, in step 222 the member 42 receives a ballot and casts her vote to the election control system 56.

The election control system 56 generates a T-TAG in step 222A, and sends a communication with the T-TAG to the vote repository system 52 in step 222B. The communication may contain a request that the vote repository system 52 store the vote content in association with the T-TAG, and create and store a ballot receipt associated with the T-TAG. In step 222C, the vote repository system 52 may store in its database 58 the T-TAG, vote content and ballot receipt.

In step 222D, the vote repository system 52 returns to the election control system 56 a communication containing the portion of the ballot receipt that the member 42 is permitted to view or hear.

In step 224, the member 42 may review her vote. The election control system does not store the ballot receipt from the communication it received in step 222D, but instead parses the receipt to a format appropriate for communicating to the particular member 42. If the member 42 voted by telephone, the vote content may be spoken to the member 42; if the member voted over the Internet, the vote content may be displayed to the user in a web browser. The member 42 may at this point approve the ballot receipt or void it and re-vote.

If the member 42 approves the ballot receipt in step 224, in step 224A, the election control system 56 communicates the T-TAG associated with the approved ballot receipt to the vote repository 52. In step 224B, the vote repository system 52 may generate and store a B-TAG and VCN associated with the approved ballot receipt. In step 224C, the vote repository system 52 sends the T-TAG, VCN, and B-TAG to the election control system 56. The vote repository system 52 may discard the T-TAG at this point. The election control system 56 relays the VCN to the member 42 in step 224 without storing the VCN, stores the B-TAG associated with the T-TAG, and discards the T-TAG.

Figure 8:
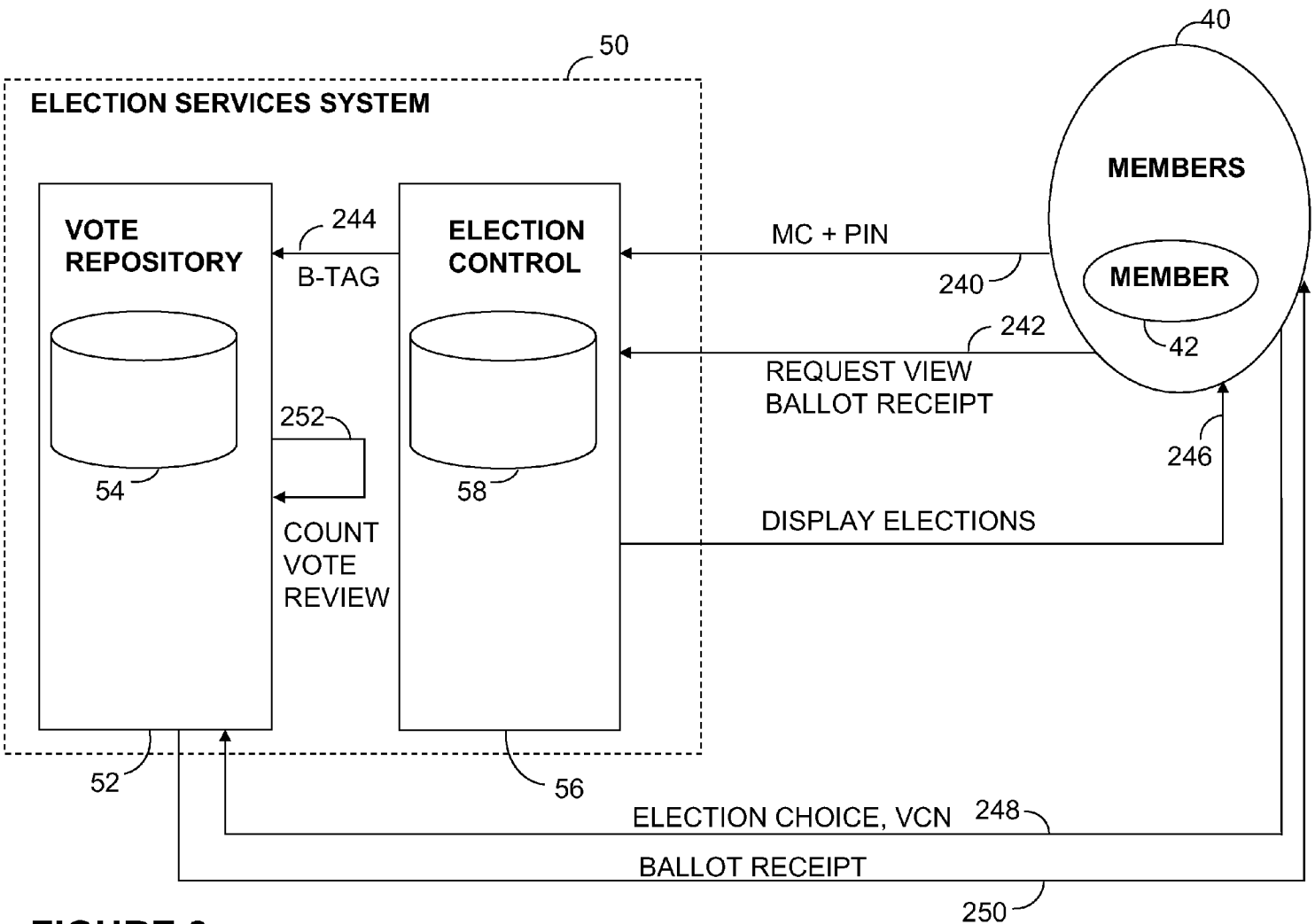
FIG. 8 is a diagram showing a possible process of the election system of FIG. 2 for voters to review their votes in a given election.

In some embodiments, voting members 40 may review their votes. FIG. 8 depicts an example of how this might be accomplished in embodiments where the election services system 50 comprises a vote repository system 52 and an election control system 56. In step 240, a member 42 logs into the election control system 56 using her MC and PIN. The election control system 56 inputs both into the same mathematical function it used when activating voter accounts and compares the result to its list of L-TAGs in database 58. If there is a match, the member 42 may be authenticated and may request to view a ballot receipt in step 242.

In step 244, the election control system 56 may send a communication containing the B-TAGs corresponding to the member's votes in one or more elections to the vote repository system 52. The vote repository system 52 may be configured to allow the member 42 access to her ballot receipt(s) for a predetermined amount of time upon receiving such a communication.

The election control system 56 may display a list of elections to the member 42, from which the member may select, in step 246. In step 248 the member 42 may be required to provide her vote confirmation number to the vote repository system 52. Upon entering any required information, the election control system 56 may redirect the user to the vote repository system 52. The vote repository system 52 may respond in step 250 by sending the member 42 her vote receipt in an appropriate format.

In embodiments where the member 42 logs in over the Internet, the election control system 56 may display the list of elections from which the member 42 may select as a webpage with a submit button. Once the member 42 selects an election, enters a VCN and clicks submit, the election control system 56 may redirect the member's web browser to the vote repository system 52, and the member 42 may review her receipt. In step 252, the vote repository 52 may add an entry to a log each time a member reviews a vote receipt.

IV. Officiating the Election

After an election, in some embodiments the group 20 holding the election may officiate the election results.

Observers 11 may also view various activities and/or data in various components in order to determine the propriety of an election. The group 20 holding an election may designate one or more independent observers 11. Optionally, the candidates in an election may choose observers 11 to monitor elections for improprieties. Observers 11 may be given access to various types of information from both the member services system 30 and the election services system 50.

Figure 9:
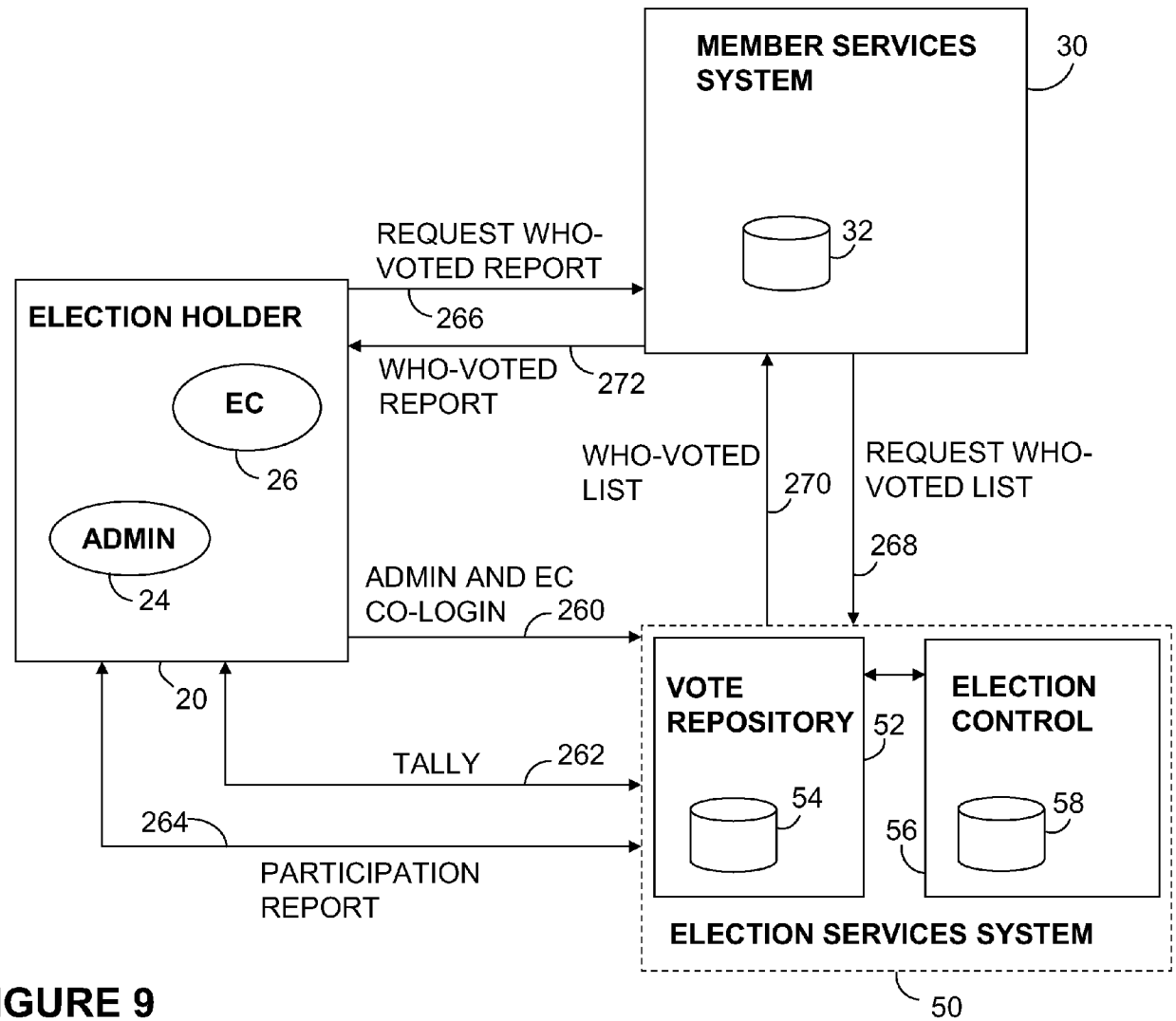
FIG. 9 is a diagram showing example processes of the election system of FIG. 2 for reporting and/or tallying the results of an election.

Officiating the election results may include obtaining the election tally and other election reports. Referring now to FIG. 9, in step 260 an ESS-ADMIN 24 and election chair 26 both may initially authenticate themselves with the election services system 50, so that they may officiate an election. In step 262, the ESS-ADMIN 24 and the election chair 26 may request and receive a tally of the election results or the raw vote content, although they may not have access to the B-TAGs associated with the vote content. If the election services system 50 includes a vote repository 52, the VR-ADMIN may log in directly to that system to obtain ballot receipts.

In step 264 the ESS-ADMIN 24 and election chair 26 may request and receive various election data, which may include the number of members 40 who participated in the election. This data may be organized by major election attribute groupings.

An MSS-ADMIN 24 and/or the election chair 26 (assuming the election chair 26 has access to member services system 30) may authenticate themselves to the member services system 30 and request a list containing names of all members 40 who voted in the election in step 266. Hereafter this list may be referred to as a "who-voted report". In step 268, the member services system 30 requests a list of M-TAGs (or MCs, depending on the embodiment) corresponding to members who voted in the election from the election services system 50. The election services system 50 returns this list in step 270.

In step 272, the member services system 30 may use the M-TAGs (or, in some embodiments, the MCs) contained in the list in conjunction with the information stored in the database 32 to construct a report detailing the names and other information about members 40 that voted in an election, but not information on how the members 40 voted.

Another aspect of the present disclosure allows for independent observers 11 authorized to view various types of information. Observers 11 may have access to similar reports and information as the election chairs 26 and/or the Administrators 22 had in FIG. 9. Additionally or alternatively, observers may be able to view administrative activity logs in any of the components, i.e. the activities of the MSS-ADMINs, ESS-ADMINs, and/or VR-ADMINs. Observers 11 may not, however, alter any information in any of the components.

FIGS. 10A-C depict examples of the data that may be stored in each component of the election system, including a single entry corresponding to a voter named Mary White. FIG. 10A shows the data that may be stored in the database 32 of the member services system 50. In this particular example, Mary's M-TAG is stored. However, it should be understood that the member services system 30 could alternatively or temporarily store Mary's MC as well, depending on the embodiment.

FIG. 10B shows information that may be stored on database 58 in an election control system 56 in embodiments where the election services system also includes a vote repository system 52. Again, the M-TAG is seen here, although in other embodiments Mary's MC could used instead. Associated with the M-TAG (and thus, Mary's vote) is an L-TAG, a B-TAG and voter attributes. As discussed above, the L-TAG may be the result of a mathematical function that used Mary's MC and PIN as input. The B-TAG identifies Mary's vote. In some embodiments, the B-TAG may not be available to the ESS-ADMIN or the VR-ADMIN. Such a restriction prevents two parties from colluding to associate the content of a vote with the identity of the voter.

FIG. 10C shows information that may be stored on database 54 in a vote repository system 52. Here, Mary's B-TAG is identical to the B-TAG stored in the election control system 56 in FIG. 10B. Mary may use the VCN that was given to Mary after she approved her vote to view her ballot receipt after logging in to the election services system 50.

As is seen in FIGS. 10A-C, various data may propagate through the election system 10 without an individual being capable of using that data to associate vote content with the identity of the voter.

In one embodiment, a MSS-ADMIN 24 may log in to the member services system 30 and change a member's voter attributes (e.g., to reflect that the member has not paid her dues) in order to void some or all of the member's votes. In such a case, the MSS-ADMIN 24 may input the updated voter attributes in relation to the member's identifying information or the member's MID stored in database 32. The member services system 30 may then relay the updated voter attributes and the associated M-TAG to the election services system 50 (or the election control system 56). Once the polling period for an election is over and it is time to tally votes, the election services system 50 may use the updated voter attributes to determine that at least some votes associated with the M-TAG should not be counted. These uncounted votes may thus be considered to have been voided.

Accordingly, while embodiments of election methods and systems have been particularly shown and described with reference to the foregoing disclosure, many variations may be made therein. Various combinations and sub-combinations of features, functions, elements and/or properties may be used. Such variations, whether they are directed to different combinations or directed to the same combinations, whether different, broader, narrower or equal in scope, are also regarded as included within the subject matter of the present disclosure. The foregoing embodiments are illustrative, and no single feature or element is essential to all possible combinations that may be claimed in this or later applications. The claims, accordingly, define selected inventions disclosed in the foregoing disclosure. Where the claims recite "a" or "a first" element or the equivalent thereof, such claims include one or more such elements, neither requiring nor excluding two or more such elements. Further, ordinal indicators, such as first, second or third, for identified elements are used to distinguish between the elements, and do not indicate a required or limited number of such elements, and do not indicate a particular position or order of such elements unless otherwise specifically stated.

What is claimed is:

1. An election system comprising at least a member services computer system and an election services computer system, the member services computer system being configured to:

store, for the members associated with an election, member-identifying information for each member and a unique first member code for each member in a group authorized to vote in an election, the first member code being related to a unique second member code, the first and second member codes not including member-identifying information;

communicate to the election services computer system the first member code for each member in the group;

receive from the election services computer system a communication indicating that a member has voted, and not receive information related to how the member voted, whereby the content of the vote of a member cannot be associated with the identification of the member using information contained in the member services computer system;

the election services computer system being configured to:

receive the first member code;

store the first member code;

authenticate each voting member accessing the elections services computer system by receiving the second member code from each voting member, and relating the received second member code to the stored first member code;

receive a vote from each authenticated voting member;

store the vote received from each authenticated voter; and not receive or store, at any time during the election, member-identifying information in association with the first member code or in association with each member vote, whereby the content of the vote of a member cannot be associated with the identification of the member that voted using information that the election services computer system is configured to store.

2. The election system of claim 1, wherein the first member code is the same as the second member code.

3. The election system of claim 1, wherein the first member code is derived from the second member code.

4. The election system of claim 3, wherein the election services computer system is further configured to not store the second member code.

5. The election system of claim 1, wherein the election services computer system is further configured to store a personal identification number associated with each member code, and authenticate a voting member at least in part by verifying that a personal identification number received from the voting member matches the personal identification number associated with the associated member code.

6. The election system of claim 5, wherein the election services computer system is further configured to:

perform a mathematical function for second each member code using the second member code and the personal identification number associated with that member code, store the results of the mathematical function as a third member code, and authenticate a voting member by verifying that a result of the mathematical function performed on a member code and personal identification number received from the voting member matches the third member code.

7. The election system of claim 1, wherein the election services computer system is further configured to receive ballot instructions, generate and store ballots based on the ballot instructions, and upon authenticating a voting member, communicate a ballot to the voting member.

8. The election system of claim 1, wherein the election services computer system is further configured to:

generate and store a static ballot receipt containing the content of the member's vote;

communicate the ballot receipt to the member;

receive approval of the ballot receipt from the member;

generate a vote confirmation number; and send the vote confirmation number to the member.

9. The election system of claim 1, wherein the election services computer system is further configured to provide reports of the election results during and after the election.

10. The election system of claim 1 wherein the member services computer system is further configured to receive voter attributes associated with each member code and send the voter attributes in association with the member codes to the election services computer system, and the election services computer system is further configured to receive from the member services computer system and store voter attributes associated with each member code and used to determine if a member is qualified to vote in the election, and wherein authenticating each voting member includes verifying that the voter attributes associated with the member code associated with the voting member qualify the voting member for voting in the election.

11. The election system of claim 1, wherein the election services computer system is further configured to receive a voter activation code from a voting member, transmit the voter activation code to the member services computer system, receive from the member services computer system the second member code associated with the voting member, and communicate the second member code to the voting member, without storing the second member code.

12. The election system of claim 1, wherein the election services computer system is further configured, upon request from the member services computer system, to remove references to an existing member code associated with one or more votes, and associate a replacement member code with the votes.

13. The election system of claim 1, wherein the election services computer system is further configured to communicate with the member services computer system over the Internet using a secure protocol.

14. The election system of claim 1, wherein the election services computer system further comprises an election control computer system and a separate vote repository computer system, wherein the election control computer system authenticates each voting member, receives the votes from the voting members, transmits the votes to the vote repository computer system, and does not store the votes, and the vote repository computer system is also separate from the member services computer system and stores the votes.

15. The election system of claim 14, wherein the vote repository computer system generates and stores ballot receipts containing the contents of the votes, and when the voting members request ballot receipts from the election control computer system, the election control computer system notifies the vote repository computer system, and the vote repository computer system communicates ballot receipts to the voting members.

16. The election system of claim 14, further comprising a first administrator having access to the election control computer system and a second administrator having access to the vote repository computer system, wherein the first administrator does not have access to member-related information stored in the vote repository system, and the second administrator does not have access to member-related information stored in the election control system.

17. The election system of claim 14, wherein the vote repository computer system is further configured to generate a unique ballot identification number for each vote and to send the ballot identification numbers to the election control computer system, and the election control computer system is further configured to tally the votes by sending a list of ballot identification numbers to the vote repository system and receiving in return a list of votes in random order.

18. The election system of claim 1, wherein the member services computer system is further configured to receive voter attributes associated with each member, and to transmit the voter attributes to the election services computer system.

19. The election system of claim 1, wherein the member services computer system is further configured to:

generate and store a unique voter activation code corresponding to each member, receive a voter activation code from the election services computer system, relate the received voter activation code to a stored voter activation code associated with a member, generate the unique first and second member codes associated with the member, store the first member code in association with the member, and transmit the first and second member codes to the election services computer system.

20. The election system of claim 19, wherein the member services computer system is further configured to not store the second member code, whereby the second member code cannot be associated with the first member code based on data stored in the member services computer system.

21. The election system of claim 19, wherein the member services computer system is further configured to discard the voter activation code after transmitting the first and second member codes to the election services computer system.

22. The election system of claim 19, wherein the member services computer system is further configured to store, for the members associated with an election, member-identifying information for each member and the first member code for each member, and use member-identifying information to communicate the voter activation codes to the corresponding members.

23. The election system of claim 1, wherein the member services computer system is further configured to:

store, for the members associated with an election, member-identifying information for each member and the first member code for each member, receive from the election services computer system a list of member codes associated with members eligible to vote in an election along with election information intended for the members, and communicate the information to members associated with received member codes, using member-identifying information associated with the stored member codes.

24. The election system of claim 1, wherein the member services computer system is further configured to store, for the members associated with an election, member-identifying information for each member, the first member code for each member, and generate a report for a specified election, whereby the report contains at least the member codes and member-identifying information associated with members who voted.

25. The election system of claim 1, wherein the member services computer system is further configured to store, for the members associated with an election, member-identifying information for each member, the first member code for each member, and communicate to each voting member, using member-identifying information, a confirmation that the member's vote was received.

26. At least a first storage medium readable by at least a first processor, having embodied therein a first program of commands executable by the first processor and at least a second program of commands executable by at least a second processor, the first program being adapted to be executed to:

store, for the members associated with an election, member-identifying information for each member, and a unique first member code for each member in a group authorized to vote in an election, the first member code being related to a unique second member code, the first and second member codes not including member-identifying information, but not content of the vote of the member;

communicate to the second processor the first member code for each member in a group;

receive from the second processor a communication indicating that a member has voted; and not receive information related to how the member voted, whereby the content of the vote of a member cannot be associated with the identification of the member using information store by the second processor; and the at least a second program being adapted to be executed to:

receive the first member code;

store the first member code;

authenticate each voting member accessing the first processor by receiving the second member code from each voting member, and relating the received second member code to the stored first member code;

receive a vote from each authenticated voting member;

store the vote received from each authenticated voter; and not receive or store, at any time during the election, member-identifying information in association with the first member code or in association with each member vote, whereby the content of the vote of a member cannot be associated with the identification of the member that voted using information stored by the first processor.

27. The at least one storage medium of claim 26, wherein the first member code is the same as the second member code.

28. The at least one storage medium of claim 26, wherein the first member code is derived from the second member code.

29. The at least one storage medium of claim 28, in which the second program is further adapted to be executed to not store the second member code.

30. The at least one storage medium of claim 27, in which the second program is further adapted to be executed to store a personal identification number associated with each member code, and authenticate a voting member at least in part by verifying that a personal identification number received from the voting member matches the personal identification number associated with the associated member code.

31. The at least one storage medium of claim 30, in which the second program is further adapted to be executed to:

perform a mathematical function for each member code using the member code and the personal identification number associated with that member code;

store the results of the mathematical functions as a third member code; and authenticate a voting member by verifying that a result of the mathematical function performed on a member code and personal identification number received from the voting member matches the third member code.

32. The at least one storage medium of claim 26, in which the second program is further adapted to be executed to receive ballot instructions, generate and store ballots based on the ballot instructions, and upon authenticating a voting member, communicate a ballot to the voting member.

33. The at least one storage medium of claim 26, in which the second program is further adapted to be executed to:

generate and store a static ballot receipt containing the content of the member's vote;

communicate the ballot receipt to the member;

receive approval of the ballot receipt from the member;

generate a vote confirmation number; and send the vote confirmation number to the member.

34. The at least one storage medium of claim 26, in which the second program is further adapted to be executed to provide reports of the election results during and after the election.

35. The at least one storage medium of claim 26 in which the first program is further adapted to be executed to:

receive voter attributes associated with each first member code, and send the voter attributes in association with the first member codes to the first processor; and the second program is further adapted to be executed to:

receive from the first processor and store voter attributes associated with each first member code and used to determine if a member is qualified to vote in the election; and verifying that the voter attributes associated with the first member code associated with the voting member qualify the voting member for voting in the election.

36. The at least one storage medium of claim 26, wherein the second program is further adapted to be executed to receive a voter activation code from a voting member, transmit the voter activation code to the first processor, receive from the first processor the second member code associated with the voting member, and communicate the second member code to the voting member, without storing the second member code.

37. The at least one storage medium of claim 26, wherein the second program is further adapted to be executed to, upon request from the first processor, remove references to an existing first member code associated with one or more votes, and associate a replacement first member code with the votes.

38. The at least one storage medium of claim 26, wherein the second program is further adapted to be executed to communicate with the first processor over the Internet using a secure protocol.

39. The at least one storage medium of claim 26, wherein the first program is further adapted to be executed to receive voter attributes associated with each member, and to transmit the voter attributes to the second processor.

40. The at least one storage medium of claim 26, wherein the first program is further adapted to be executed to:

generate and store a unique voter activation code corresponding to each member;

receive a voter activation code from the second processor;

relate the received voter activation code to a stored voter activation code associated with a member;

generate the unique first and second member codes associated with the member;

store the first member code in association with the member; and transmit the first and second member codes to the first processor.

41. The at least one storage medium of claim 40, wherein the first program is further adapted to be executed to not store the second member code, whereby the second member code cannot be associated with the first member code based on data stored by the first processor.

42. The at least one storage medium of claim 40, wherein the first program is further adapted to be executed to discard the voter activation code after transmitting the first and second member codes to the second processor.

43. The at least one storage medium of claim 40, wherein the first program is further adapted to be executed to use member-identifying information to communicate the voter activation codes to the corresponding members.

44. The at least one storage medium of claim 26, wherein the first program is further adapted to be executed to:

receive from the first processor a list of first member codes associated with members eligible to vote in an election along with election information intended for the members, and communicate the information to members associated with received member codes, using member-identifying information associated with the stored first member codes.

45. The at least one storage medium of claim 26 wherein the first program is further adapted to be executed to generate a report for a specified election, whereby the report contains at least the first member codes and member-identifying information associated with members who voted.

46. The at least one storage medium of claim 26, wherein the first program is further adapted to be executed to store, for the members associated with an election, member-identifying information for each member, the first member code for each member, and communicate to each voting member, using member-identifying information, a confirmation that the member's vote was received.

47. The at least one storage medium of claim 26, wherein the at least a second program includes a third program of commands executable by a third processor to store the votes.

48. The at least one storage medium of claim 26, wherein the third program is further adapted to be executed to generate and store ballot receipts containing the contents of the votes, and when the voting members request ballot receipts from the second processor, the second program is further adapted to be executed to notify the third processor, and the third program is further adapted to be executed to communicate ballot receipts to the voting members.

49. The at least one storage medium of claim 26, wherein the second program is further adapted to be executed to allow a first administrator access to the second processor, and the third program is further adapted to be executed to allow a second administrator access to the third processor, wherein the first administrator does not have access to member-related information stored by the third processor, and the second administrator does not have access to member-related information stored by the second processor.

50. The at least one storage medium of claim 26, wherein the third program is further adapted to be executed to generate a unique ballot identification number for each vote and to send the ballot identification numbers to the second processor, and the second program is further adapted to be executed to tally the votes by sending a list of ballot identification numbers to the third processor and receive in return a list of votes in random order.

* * * * *